United States Patent [19]

Engström

[11] Patent Number: 4,483,905

[45] Date of Patent: Nov. 20, 1984

[54] HOMOGENEOUS IRON BASED POWDER MIXTURES FREE OF SEGREGATION

[75] Inventor: Ulf F. I. Engström, Höganäs, Sweden

[73] Assignee: Hoganas AG, Höganäs, Sweden

[21] Appl. No.: 236,559

[22] Filed: Feb. 20, 1981

[30] Foreign Application Priority Data

Mar. 6, 1980 [SE] Sweden ..... 8001764

[51] Int. Cl.[3] ..... B22F 1/00

[52] U.S. Cl. ..... 428/570; 49/65; 75/231; 75/251; 75/252; 75/255; 419/2; 419/35; 419/36; 419/37

[58] Field of Search ..... 428/570; 419/2, 35, 419/36, 37; 75/252, 251, 255, 231; 49/65

[56] References Cited

U.S. PATENT DOCUMENTS

| | | | |
|---|---|---|---|
| 3,307,924 | 3/1967 | Michael | 428/570 |
| 3,470,019 | 9/1969 | Steele | 428/570 |
| 3,516,933 | 6/1970 | Andrews et al. | 75/252 |
| 3,988,524 | 10/1976 | Dreyer et al. | 75/252 |
| 4,062,678 | 12/1977 | Dreyer et al. | 419/32 |
| 4,106,932 | 8/1978 | Blachford | 75/252 |
| 4,181,525 | 1/1980 | Novinski | 428/570 |

FOREIGN PATENT DOCUMENTS

| | | | |
|---|---|---|---|
| JA08352 | 1/1978 | Japan | 428/570 |

*Primary Examiner*—Veronica O'Keefe

*Attorney, Agent, or Firm*—Burns, Doane, Swecker & Mathis

[57] ABSTRACT

A metal powder containing particles of iron or steel and particles of an alloying element is apt to segregation and dusting. It has now been found that segregation and dusting can be reduced or eliminated if the powder contains a binding agent in solid or liquid state. It is preferred to add to the metal powder one of the agents polyethylene glycol, polypropylene glycol, glycerine, and polyvinyl alcohol, in a quantity of 0.005–0.2 percent by weight.

6 Claims, No Drawings

HOMOGENEOUS IRON BASED POWDER MIXTURES FREE OF SEGREGATION

The present invention relates to homogeneous iron based powder mixes with low risk of segregation and/or dusting. According to this invention it is now possible to produce mechanical mixes of iron or steel powders and alloying powders with low risk of segregation and dusting without deteriorating the characteristic physical properties of the mixture.

In powder metallurgical manufacturing of various types of components iron or steel powders are often used together with one or more alloying elements such as copper or nickel in order to reach mechanical properties which cannot be obtained when using plain iron or steel powders.

Nowadays powders for these purposes are in general prepared in two ways, viz. either as powder mixtures or as fully prealloyed powders. Powder mixtures are prepared by mixing the iron or steel powder with powder containing the desired alloying element or elements, either in the elementary form or as master alloys. The fully prealloyed steel powders are manufactured e.g. by atomizing a steel melt containing the desired alloying elements to a powder.

One of the drawbacks of powder mixtures is related to the fact that such powders consist of particles which often differ considerably in size, shape and density, and which are not mechanically interconnected. This means that such a powder mixture is susceptible to segregation during its transport and handling. This segregation leads to varying composition of the green compacts manufactured from the powder, and thus to varying dimensional changes during the sintering operation and to varying mechanical properties in the as-sintered product.

Another drawback of powder mixtures is their tendency to dust especially if the alloying element is present in the form of very small particles. This can lead to difficult environmental problems when the powder mixture is handled.

In the case of fully prealloyed powders there is no risk of segregation as every powder particle has the same composition. Also the risk of dusting is reduced as no alloying powder having small particle size is included. However, the prealloyed powder has another great drawback, viz. its low compressibility which is a result of the solid solution hardening effect which the alloying elements have on each powder particle. High compressibility is essential when high density is a prerequisite for reaching high mechanical properties.

The compressibility of a powder mixture is on the other hand substantially the same as the compressibility of the iron powder included therein. This fact together with the flexibility as regards the alloying composition have made powder mixtures the most commonly used raw material in the production of low alloy sintered steels. In such powder mixtures the plain iron powder is used as a base powder.

The Swedish patent application No. 7612217-5 describes a method to produce an iron powder containing copper, which has a low risk of segregation and dusting at the same time as the powder properties are maintained. According to this method the powder is produced by an annealing treatment of a mixture of iron and copper powder, at which a so-called partially diffusion alloy between iron and copper is obtained.

As certain alloying elements, such as e.g. phosphorus in the form of a ferrophosphorus powder and carbon in the form of graphite powder, cannot be sufficiently diffusion alloyed with an iron or steel powder without deteriorating the compressibility, there is a risk that mixtures in which these alloying elements are used are prone to segregation and/or dusting.

The aim of the present invention is therefore to provide powder mixtures on iron powder base, in which the risk of segregation and dusting is very low at the same time as the physical powder characteristics are maintained.

According to the invention this aim is fulfilled by adding during the mechanical mixing operation a binding agent by means of which the fine alloying particles are attached to the coarser iron or steel powder particles.

According to the invention it is proposed to use binding agents with a sticky or fat character and the properties of which are such that they do not evaporate or change chemically with time at normal temperatures. It has been proved that binding agents of this nature can stand the internal forces that might arise when the powder mixture is handled. Binding agents, which harden with time, however, will give cause to hard and brittle bridges between the different particles which have proved not to be able to withstand these forces.

In order to distribute the binding agent homogeneously in the powder mixture it is preferred to use binding agents with good wetting properties. When a solid binder is used it can be dissolved in a solvent which is evaporated after the mixing operation. Alternatively the properties of the solid binder can be chosen in such a way that the binder melts during the mixing operation and is then distributed in the mixture in liquid state.

The melting of the binder can either be a result of the heat generated during the mixing operation as a consequence of the friction between the particles, or the whole mixer can be heated by an external heat source to the desired temperature.

Furthermore, the binding agent should have such properties that it can be burned off without any problems at a suitable temperature, e.g. during the sintering of the components made of the powder mixture.

As the binder should be active in the powder mixture until after the compaction it is not allowed to affect the characteristic physical powder properties of the mixture such as apparent density, flow, compressibility and green strength.

To fulfil the above mentioned demands it is preferred to add 0.005–1.0%, preferably 0.005–0.2% of a suitable binder. Here and in the following "%" is referred to as percent of weight.

Binding agents that are preferred are polyethyleneglycols, polypropyleneglycols, polyvinylalcohol and glycerol.

According to the invention an iron based powder is mixed with one or more alloying powders for some minutes in order to obtain some homogenization of the mixture. A total content of 0.005–1.0%, preferably 0.005–0.2% of the binder is then added either in liquid or solid state and the mixing operation is carried out for a period of time sufficient to obtain a homogeneous mixture. If desired, a lubricant might be added during the mixing operation to facilitate the pressing of the powder in a tool at the final use.

In the following the invention is exemplified and in connection therewith the experiments which have been made with powder according to the invention are described together with the surprising results which the experiments have given.

EXAMPLE 1

Three powder mixtures A, B and C with the following composition were prepared.

Mixture A: 97.0% iron powder having a particle size substantially between 417 μm (35 mesh) and 147 μm (100 mesh), 3% ferrophosphorus alloy powder with a phosphorus content of 15% and a maximum particle size of 44 μm (325 mesh)

Mixture B: 96.8% iron powder with a particle size substantially between 417 μm (35 mesh) and 147 μm (100 mesh), 3.0% ferrophosphorus alloy powder with a phosphorus content of 15% and a maximum particle size of 44 μm (325 mesh) and 0.2% polyethyleneglycol.

Mixture C: 96.0% iron powder with a particle size substantially between 417 μm (35 mesh) and 147 μm (160 mesh), 3.0% ferrophosphorus alloy powder with a phosphorus content of 15% and a maximum particle size of 44 μm (325 mesh) and 1.0% polyethyleneglycol.

A representative test portion of 100 grams of each mix A, B and C were screened on a sieve with an opening of 44 μm (325 mesh). The amount of powder that passed through the sieve was measured and the following results were obtained:

| Mixture | Amount of powder smaller than 44 μm (325 mesh) |
|---|---|
| A | 2.49 grams |
| B | 0.10 grams |
| C | 0.01 grams |

As the iron powder used had a particle size exceeding 147 μm (100 mesh) and the ferrophosphorus powder used had a particle size of maximum 44 μm (325 mesh) the powder which had passed through the sieve openings was solely the ferrophosphorus alloy powder. As can be seen from the above table the addition of the binding agent has resulted in a very effective binding of the ferrophosphorus particles to the iron particles.

The mixtures A, B and C were also examined regarding some characteristic powder properties, which gave the following results:

| Mixture | Apparent density g/cm$^3$ | Flow s/50 g | Compressibility g/cm$^3$ |
|---|---|---|---|
| A | 3.10 | 30 | 6.82 |
| B | 3.08 | 30 | 6.82 |
| C | 3.08 | — | 6.81 |

The results of the experiment described above show that the risk for segregation in a powder mixture containing iron powder and ferrophosphorus alloy powder can be substantially decreased without deteriorating the powder properties. When such a high addition of binding agent is used as in mixture C the powder properties, however, are changed in such a way that this powder does not flow.

EXAMPLE 2

When iron based powder mixtures containing carbon, added in the form of graphite powder, are produced it is wellknown that dusting of the graphite powder occurs when the mixer is emptied. This effect increases towards the end of the emptying procedure. This phenomenon will result in a variation of the carbon content in the mixture. In particular the carbon content in the powder mixture that is obtained at the end of the emptying process will be increased. However, by the addition of a binding agent this segregation/dusting effect can be eliminated, which is shown by the following experiment.

A powder mixture of totally 10 tons, in the following called D, consisting of 2.5% copper powder, 0.6% graphite powder and the rest being sponge iron powder with a particle size substantially below 147 μm were mixed with 0.8% zinc stearate for 10 minutes in a double cone mixer. The mixture was then emptied in 10 barrels each containing 1 ton of powder. From the top of each barrel a test portion of 1 kilo was taken and examined with regard to powder properties and carbon content. The chemical analysis of the carbon content was carried out in such a way that only the amount of graphite was determined, i.e. the influence of the lubricant was eliminated.

At the same time a powder mixture of 10 tons was produced, in the following called E, with the same analysis as mixture D but during the mixing operation 0.02% polyethyleneglycol was injected into the mixer. After the addition of the binding agent 0.8% zinc stearate powder was admixed for 5 minutes. The powder mixture was then emptied in 10 barrels each containing 1 ton of powder and a test portion of 1 kilo was taken from the top of each barrel. The same examination as described for mixture D was carried out and the following results were obtained:

| | Mixture D | Mixture E |
|---|---|---|
| C-analysis on the top of last emptied barrel, % | 0.65 | 0.59 |
| Average-C-content on the top of the other barrels, % | 0.56 | 0.58 |
| Apparent density, g/cm$^3$ | 2.78 | 2.79 |
| Flow, s/50 g | 35 | 35 |
| Compressibility, g/cm$^3$ | 6.74 | 6.74 |

As can be seen from the results a much more homogeneous carbon content was obtained in the powder mixture when the binder had been added with the characteristic powder properties being maintained.

For a person skilled in the art it is a surprising and unexpected effect that such a small addition of the binding agent can be homogeneously admixed and bind the graphite particles to the iron particles.

According to the invented method it is possible to produce powder mixtures on iron base in which the risk of segregation and/or dusting is very low.

I claim:

1. In a non-compacted powder composition formed by mechanical mixing primarily comprising an iron-based powder selected from the group consisting of iron and steel powder together with a minor amount of at least one alloying powder, the improvement wherein said composition further comprises in intimate contact with said iron-based powder and said at least one alloying powder from 0.005 to 1.0 percent by weight of a binding agent in solid or liquid state for said iron-based powder and said alloying powder whereby segregation and/or dusting of the iron-based powder and said at least one alloying powder is essentially precluded, with said mechanical mixing used to form said composition having been conducted while said binding agent is provided as a liquid.

2. The non-compacted powder composition of claim 1, wherein the composition comprises from 0.005 to 0.2 weight percent of the binding agent.

3. The non-compacted powder composition of claim 1, wherein the binding agent is selected from the group consisting of polyethylene glycol, polypropylene glycol, glycerine and polyvinyl alcohol.

4. The non-compacted powder composition of claim 2, wherein the binding agent is selected from the group consisting of polyethylene glycol, polypropylene glycol, glycerine and polyvinyl alcohol.

5. The non-compacted powder composition of claim 1, wherein the amount of alloying powder comprises about 3 percent by weight.

6. The non-compacted powder composition of claim 1, wherein said composition is free-flowing.

* * * * *

US004483905B1

REEXAMINATION CERTIFICATE (3116th)

United States Patent [19] [11] B1 4,483,905

Engström [45] Certificate Issued Feb. 4, 1997

[54] HOMOGENEOUS IRON BASED POWDER MIXTURES FREE OF SEGREGATION

[75] Inventor: Ulf F. I. Engström, Höganäs, Sweden

[73] Assignee: Hoganas AB, Hoganas, Sweden

Reexamination Request:
No. 90/003,795, Apr. 17, 1995

Reexamination Certificate for:

| | |
|---|---|
| Patent No.: | **4,483,905** |
| Issued: | **Nov. 20, 1984** |
| Appl. No.: | **236,559** |
| Filed: | **Feb. 20, 1981** |

[30] Foreign Application Priority Data

Mar. 6, 1980 [SE] Sweden ..... 8001764

[51] Int. Cl.[6] ..... B22F 1/00

[52] U.S. Cl. ..... 428/570; 75/231; 75/252; 75/255; 419/65

[58] Field of Search ..... 75/231, 246, 252, 75/255; 419/2, 35, 36, 37, 65; 428/570

[56] References Cited

U.S. PATENT DOCUMENTS

| | | | |
|---|---|---|---|
| 2,173,100 | 9/1939 | Drapeau et al. | 75/252 |
| 3,120,698 | 2/1964 | Elliott et al. | 75/230 |
| 3,357,818 | 12/1967 | Findeisen | 75/252 |
| 3,704,508 | 12/1972 | Di Giambattista | 419/23 |
| 3,728,110 | 4/1973 | Klas et al. | 75/231 |
| 3,836,355 | 9/1974 | Lindskog et al. | 75/252 |
| 3,853,572 | 12/1974 | Herron et al. | 75/231 |
| 4,093,449 | 6/1978 | Svensson et al. | 75/252 |
| 4,129,444 | 12/1978 | Dreyer et al. | 75/252 |

FOREIGN PATENT DOCUMENTS

| | | |
|---|---|---|
| 2151952 | 4/1973 | Germany . |
| 48-15125 | 5/1973 | Japan . |
| 364546 | 2/1932 | United Kingdom . |
| 1162702 | 8/1969 | United Kingdom . |
| 1258787 | 12/1971 | United Kingdom . |
| 1457661 | 8/1976 | United Kingdom . |

OTHER PUBLICATIONS

C. G. Goetzel, Ph.D., *Treatise on Powder Metallurgy*, vol. I, (1949), pp. 107–108, 248–257.

*Primary Examiner*—George Wyszomierski

[57] ABSTRACT

A metal powder containing particles of iron or steel and particles of an alloying element is apt to segregation and dusting. It has now been found that segregation and dusting can be reduced or eliminated if the powder contains a binding agent in solid or liquid state. It is preferred to add to the metal powder one of the agents polyethylene glycol, polypropylene glycol, glycerine, and polyvinyl alcohol, in a quantity of 0.005–0.2 percent by weight.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeard in the patent, but has been deleted and is no longer a part of the patent; matter printed in italics indicates additions made to the patent.

AS A RESULT OF REEXAMINATION, IT HAS BEEN DETERMINED THAT:

Claims 2, 4, and 6 are cancelled.

Claims 1 and 3 are determined to be patentable as amended.

Claim 5, dependent on an amended claim, is determined to be patentable.

New claims 7, 8 and 9 are added and determined to be patentable.

1. In a non-compacted powder composition formed by mechanical mixing primarily comprising an iron-based powder selected from the group consisting of iron and steel powder together with a minor amount of at least one alloying powder, the improvement wherein said composition further comprises in intimate contact with said iron-based powder and said at least one alloying powder from 0.005 to [1.0] *0.2* percent by weight of a binding agent in solid [or liquid] state for said iron-based powder and said alloying powder whereby segregation and/or dusting of the iron-based powder and said at least one alloying powder is essentially precluded, [with said mechanical mixing used to form said composition having been conducted while said binding agent is provided as a liquid] *with said composition having been formed by said mechanical mixing while said binding agent is provided as a liquid, and wherein said non-compacted powder composition is free-flowing and is suitable for forming into a green compact and sintering of said compact.*

3. The non-compacted powder composition of claim 1, wherein the binding agent is selected from the group consisting of polyethylene glycol, polypropylene glycol, [glycerine] and polyvinyl alcohol.

*7. The non-compacted powder composition of claim 1 wherein the binding agent is polyvinyl alcohol.*

*8. In a non-compacted powder composition formed by mechanical mixing primarily comprising an iron-based powder selected from the group consisting of iron and steel powder together with a minor amount of at least one alloying powder, the improvement wherein said composition further comprises in intimate contact with said iron-based powder and said at least one alloying powder from 0.005 to 0.2 percent by weight of a binding agent in solid state for said iron-based powder and said alloying powder whereby segregation and/or dusting of the iron-based powder and said at least one alloying powder is essentially precluded, with said mechanical mixing used to form said composition having been conducted while said binding agent is provided as a liquid, and wherein said non-compacted powder composition is free-flowing, and wherein the binding agent is polyethylene glycol.*

*9. In a non-compacted powder composition formed by mechanical mixing primarily comprising an iron-based powder selected from the group consisting of iron and steel powder together with a minor amount of at least one alloying powder, the improvement wherein said composition further comprises in intimate contact with said iron-based powder and said at least one alloying powder from 0.005 to 0.2 percent by weight of a binding agent in solid state for said iron-based powder and said alloying powder whereby segregation and/or dusting of the iron-based powder and said at least one alloying powder is essentially precluded, with said mechanical mixing used to form said composition having been conducted while said binding agent is provided as a liquid, and wherein said non-compacted powder composition is free-flowing, and wherein the binding agent is polypropylene glycol.*

* * * * *